US011578717B2

(12) United States Patent
Cornett et al.

(10) Patent No.: US 11,578,717 B2
(45) Date of Patent: Feb. 14, 2023

(54) PUMP ACTUATOR WITH STAMP-ALIGNED ANTI-ROTATION FEATURE

(71) Applicant: Eaton Intelligent Power Limited, Dublin (IE)

(72) Inventors: Douglas Ray Cornett, Roxboro, NC (US); Adam Greg Paul, Durham, NC (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/477,944

(22) PCT Filed: Jan. 23, 2018

(86) PCT No.: PCT/US2018/014864
§ 371 (c)(1),
(2) Date: Jul. 15, 2019

(87) PCT Pub. No.: WO2018/140403
PCT Pub. Date: Aug. 2, 2018

(65) Prior Publication Data

US 2019/0368485 A1 Dec. 5, 2019

Related U.S. Application Data

(60) Provisional application No. 62/451,495, filed on Jan. 27, 2017.

(51) Int. Cl.

| | |
|---|---|
| ***F04B 53/14*** | (2006.01) |
| ***F02M 59/10*** | (2006.01) |
| ***F04B 9/04*** | (2006.01) |

(52) U.S. Cl.
CPC ..... *F04B 53/146* (2013.01); *F02M 59/102* (2013.01); *F04B 9/042* (2013.01)

(58) Field of Classification Search
CPC . F01L 1/14; F01L 1/143; F04B 53/146; F04B 9/042; F02M 59/102; Y10T 29/49304
(Continued)

(56) References Cited

U.S. PATENT DOCUMENTS

| | | | |
|---|---|---|---|
| 7,793,583 | B2 | 9/2010 | Radinger et al. |
| 8,201,532 | B2 | 6/2012 | Prokop |

(Continued)

FOREIGN PATENT DOCUMENTS

| | | | |
|---|---|---|---|
| CN | 102588026 | A | 7/2012 |
| CN | 106014735 | A | 10/2016 |

(Continued)

OTHER PUBLICATIONS

International Search Report and Written Opinion for PCT/US2018/014864; dated Apr. 26, 2018; pp. 1-12.

*Primary Examiner* — Devon C Kramer
*Assistant Examiner* — Kelsey L Stanek
(74) *Attorney, Agent, or Firm* — Baker Botts L.L.P.

(57) ABSTRACT

A tappet, which may be a fuel pump actuator, includes a body that is a contiguous piece of case-hardened ferrous metal. The body has a cylinder-conforming bore-running surface and an anti-rotation guide feature that has been made by stamping to project outwardly from the bore-running surface. A cam follower is mounted to the body. The body has been case hardened by ferritic nitrocarburizing, but has not been distorted by heat treatment and has a malleable interior. A transverse web for the tappet may be fully hardened. Axle holes for the cam follower may be formed by stamping. The tappet is durable and provides superior alignment of the roller to a cam, which reduces friction and noise.

20 Claims, 4 Drawing Sheets

(58) Field of Classification Search
USPC ..... 123/90.48, 90.5
See application file for complete search history.

(56) References Cited

U.S. PATENT DOCUMENTS

| | | | | |
|---|---|---|---|---|
| 8,474,427 | B2 * | 7/2013 | Dorn | F04B 9/04 123/90.48 |
| 8,607,754 | B2 | 12/2013 | Dorn et al. | |
| 9,243,521 | B2 | 1/2016 | Cornett et al. | |
| 9,422,834 | B2 | 8/2016 | Fujii et al. | |
| 2008/0190237 | A1 * | 8/2008 | Radinger | F01L 1/143 74/569 |
| 2011/0265752 | A1 | 11/2011 | Dorn et al. | |
| 2012/0152187 | A1 * | 6/2012 | Cornett | F01L 1/143 123/90.5 |
| 2012/0234277 | A1 | 9/2012 | Dorn et al. | |
| 2015/0090211 | A1 * | 4/2015 | Champalou | F16H 53/06 123/90.48 |
| 2015/0211624 | A1 * | 7/2015 | Pasaribu | F16C 33/6633 74/416 |
| 2015/0330264 | A1 * | 11/2015 | Hauvespre | F01L 1/14 74/519 |
| 2015/0337939 | A1 | 11/2015 | Van Der Mei et al. | |
| 2015/0369097 | A1 * | 12/2015 | Hauvespre | F01L 1/143 74/559 |
| 2016/0084116 | A1 | 3/2016 | Ludwig et al. | |
| 2016/0102395 | A1 * | 4/2016 | Singh | C23C 8/80 148/219 |
| 2016/0153321 | A1 * | 6/2016 | Berruet | F01L 1/18 123/90.44 |
| 2016/0160986 | A1 * | 6/2016 | Berruet | F04B 9/042 74/569 |
| 2016/0230610 | A1 * | 8/2016 | Berruet | F04B 1/0417 |
| 2016/0305290 | A1 | 10/2016 | Guillame et al. | |
| 2017/0097065 | A1 * | 4/2017 | Costa | C23C 28/044 |

FOREIGN PATENT DOCUMENTS

| | | | |
|---|---|---|---|
| GB | 2240829 | A | 8/1991 |
| KR | 1020120106740 | A | 9/2012 |

* cited by examiner

PUMP ACTUATOR WITH STAMP-ALIGNED ANTI-ROTATION FEATURE

FIELD

The present disclosure relates to tappets for internal combustion engines, especially pump actuators for high pressure fuel pumps.

BACKGROUND

A tappet translates the rotational motion of a cam into a reciprocating motion. A tappet body generally includes a cylinder-conforming bore-running surface that guides the tappet as it reciprocates within a bore. A roller may be mounted at a drive input end of the tappet body to follow a cam that drives the tappet. High-pressure fuel pump actuation is one of the more demanding tappet applications. Pump actuator tappets generally require hardened ferrous metal to meet operating life requirements.

Alignment between the roller and the cam is critical to keeping friction and noise within acceptable limits. The tappet may have an anti-rotation guide feature to keep the roller axis aligned in a plane with the cam axis. The mounting of the roller to the tappet body may be relied on to keep the roller axis perpendicular to the bore axis and parallel to the cam axis.

SUMMARY

One aspect of the present teachings is a tappet that includes a body that is a contiguous piece of case-hardened ferrous metal. The body has a cylinder-conforming bore-running surface and an anti-rotation guide feature that has been made by stamping to project outwardly from the bore-running surface. A cam follower is mounted to the body. A tappet according to the present teachings provides superior alignment of the roller to the cam, which reduces friction and noise.

Another aspect of the present teachings is a tappet formed by a process that includes forming a body out of ferrous metal with a surface that includes a cylinder-conforming bore-running surface, stamping the body to form an anti-rotation guide feature projecting outward from the bore-running surface, case hardening the body by a process that adds nitrogen to the ferrous metal at sub-critical temperatures, and attaching a cam follower to the body.

Another aspect of the present teachings is a method of manufacturing a tappet. The method includes forming ferrous sheet metal to provide a cylinder-conforming bore-running surface, stamping by which there is formed an anti-rotation guide feature projecting outward from the cylinder-conforming bore-running surface, case hardening the body by a process that adds nitrogen to the ferrous metal while maintaining the ferrous metal in a ferritic state, and mounting a cam follower at one end of the body.

The alignment of the roller is largely determined by the geometric relationships between the roller mounting, the bore-running surface, and the anti-rotation guide. In a tappet according to the present teachings, these relationships may be controlled through stamping processes. Stamping forms the anti-rotation guide feature and features on the body that relate to the relative location of the roller. In some of these teachings, the body includes two parallel planar surfaces that are formed by stamping and are proximate a drive-input end of the body. Axle holes may be formed in these planar surfaces and an axial support pin for the cam follower may be mounted through those axle holes. The orientation of those planar surfaces relative to the anti-rotation guide feature contributes to the roller alignment. In some of these teachings axle holes for the cam follower are formed by stamping. A stamping process that forms axle holes may include piercing and shaving. Forming the axle holes by stamping improves the roller alignment.

The cylinder-conforming bore-running surface is operative to engage a first cylindrical bore to guide translation of the tappet within the bore. The axis of the bore-running surface becomes coaligned with the bore axis. A cam is arranged with its contact surface perpendicular to the bore. In some of these teachings, the anti-rotation guide feature is operative to engage a second cylindrical bore having a smaller diameter than first cylindrical bore and intersecting the first cylindrical bore. In this configuration, the anti-rotation guide feature restricts rotation of the tappet within the first cylindrical bore.

According to some of the present teachings, the body is not subjected to any hardening process that heats the metal above the critical temperature. The critical temperature is the temperature at which the metal transition from a ferritic phase to an austenitic phase. For example, the body is not subjected to carbonitriding, which is a conventional case hardening process. Carbonitriding involves heating the metal above the critical temperature. If the body were subjected to carbonitriding before stamping, the metal would have insufficient malleability for the stamping process. If the body were subjected to carbonitriding after stamping, the cylinder-conforming bore-running surface would be distorted and the anti-rotation guide feature would interfere with processing to restore circularity to the bore-running surface.

The body of a prior art tappet is subjected to carbonitriding. The hardening process results in shape distortion. The outer surface of the body is returned to a cylinder-conforming shape by a process such as OD grinding, which removes metal from the surface. It was found, however, that carbonitriding and OD grinding can alter the geometric relationship between the roller mounting and the bore-running surface. In the present teachings, these processes may be avoided. In some of the present teachings, the body lacks distortions of the type that would be produced by a hardening process that involves heating the body above the critical temperature.

In some of the present teachings, the bore-running surface does not bear evidence of any operation that has contributed to determining its outer diameter and that has not also been applied to the surface of the anti-rotation guide. In some of the present teachings, a final outer diameter for the cylinder-conforming bore-running surface is produced without any grinding, milling, or abrading that affects the outer diameter. The outer diameter may be largely determined prior to stamping, although case hardening may have a measurable effect on the outer diameter. In some of the present teachings, the body is formed from sheet metal by deep drawing. In some of the present teachings, the outer diameter of the body is determined by processes consisting essentially of deep drawing, stamping, and case hardening. In some of the present teachings, the metal that provides the bore-running surface is present at the surface of the body prior to stamping. The body is case hardened, but in accordance with some of the present teachings, the body has an interior that is comparatively malleable.

In some aspects of the present teachings, the tappet is a pump actuator. In some of these teachings, the tappet is a high-pressure fuel pump actuator. The pump actuator application requires high fatigue resistance. In the present teachings, the body is case hardened by a process that adds nitrogen to the ferrous metal while maintaining the ferrous metal in a ferritic state. In some of these teachings, the case hardening process is ferritic nitrocarburizing. A case hardening process is one that modifies the metal proximate the surface of a part to provide a hardened shell.

A crossmember may be installed within the body. In some of these teachings, the crossmember is ferrous metal hardened through its full thickness whereas the body has an interior that is malleable. Hardening the crossmember through its full thickness includes heating the crossmember to temperatures at which the ferrous metal enters an austenitic phase. In some of these teachings, the crossmember is mounted within the body by a process that includes crimping to secure the crossmember within the body.

Because the anti-rotation guide feature is formed by stamping the metal that also provides the bore-running surface, the anti-rotation guide feature is contiguous with the bore-running surface. In some of these teachings, the anti-rotation guide feature has a length extending along an axis of the cylinder-conforming bore-running surface and the anti-rotation guide feature meets the cylinder-conforming bore-running surface along two opposite sides of the anti-rotation guide feature both of which extend along the length. In some of these teachings, an interface between the anti-rotation guide feature and the cylinder-conforming bore-running surface forms a perimeter about the anti-rotation guide feature. This means that the anti-rotation guide is continuous with the bore-running surface on all sides.

In some of these teachings, the body comprises two parallel planar surfaces at its drive-input end, an axle hole is formed in each of the two planar surfaces, an axial support pin for the cam follower is mounted through the axle holes, and the body further comprises two additional surfaces that are substantially planar. The two additional surfaces are within transition regions between the cylinder-conforming bore-running surface and the two parallel planar surfaces. The additional surfaces are adjacent the parallel planar surfaces at ends of the parallel planar surfaces that are distal from a drive-input end of the body. In some of these teachings, the additional surfaces are inclined relative to an axis of the cylinder-conforming bore-running surface and the angle of inclination is in the range from 15 to 75 degrees. Having those surfaces so inclined reduces the weight of the tappet while maintaining or increasing its fatigue resistance.

The primary purpose of this summary has been to present certain of the inventors' concepts in a simplified form to facilitate understanding of the more detailed description that follows. This summary is not a comprehensive description of every one of the inventors' concepts or every combination of the inventors' concepts that can be considered "invention". Other concepts of the inventors will be conveyed to one of ordinary skill in the art by the following detailed description together with the drawings. The specifics disclosed herein may be generalized, narrowed, and combined in various ways with the ultimate statement of what the inventors claim as their invention being reserved for the claims that follow.

DETAILED DESCRIPTION

Figure 1:
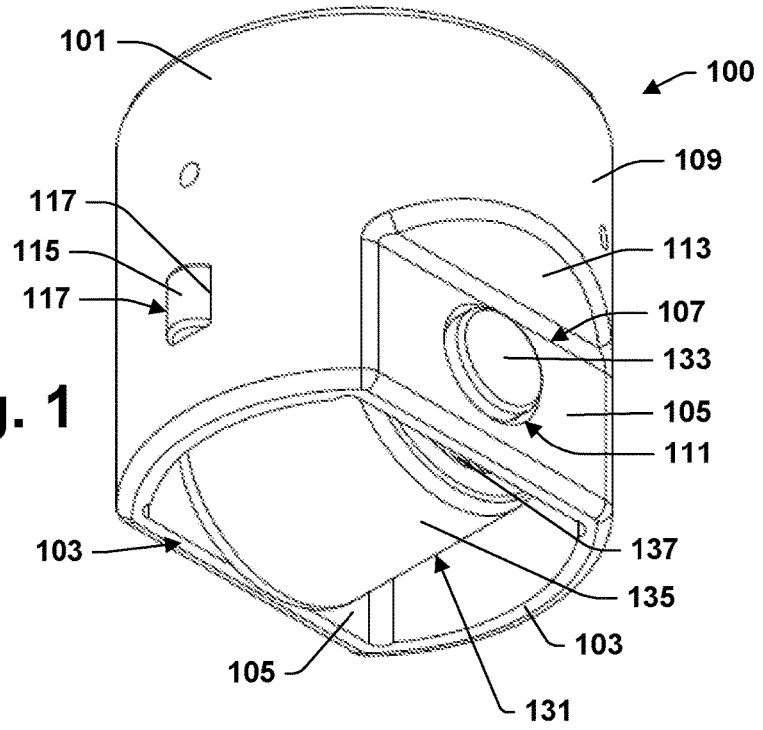
FIG. 1 is a perspective view of a tappet according to some aspects of the present teachings.
Figure 2:
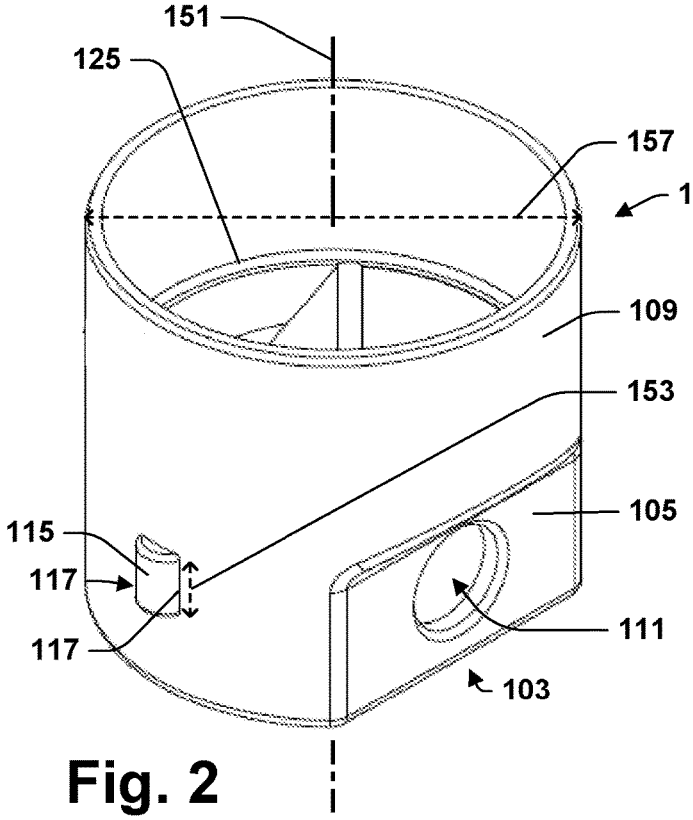
FIG. 2 is a perspective view of the body of the tappet of FIG. 1 prior to assembly.
Figure 3:
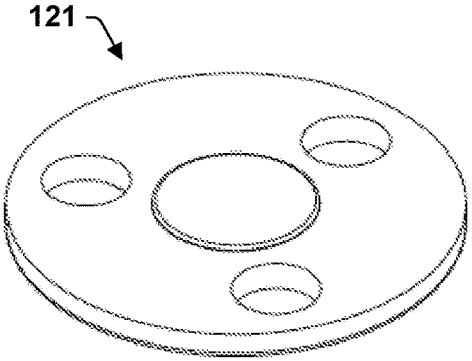
FIG. 3 is a perspective view of a crossmember of the tappet of FIG. 1.
Figure 4:
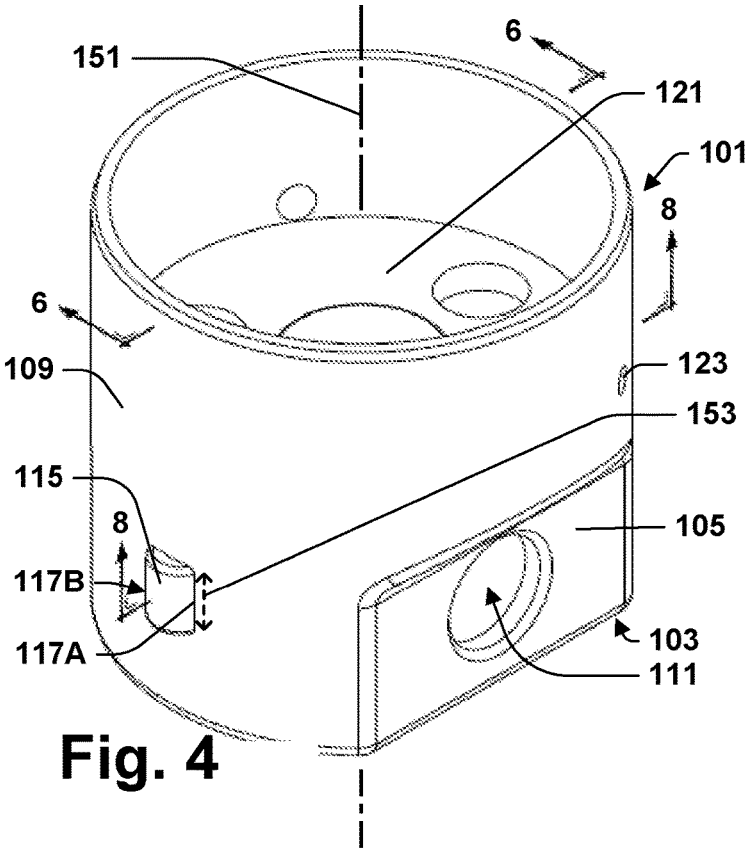
FIG. 4 is a perspective view of the body of FIG. 2 and the crossmember of FIG. 3 after assembly.
Figure 6:
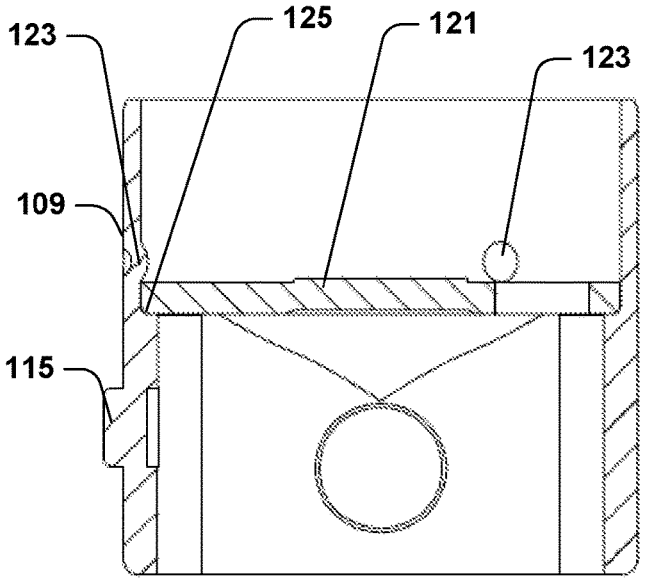
FIG. 6 is a cross-section taken through the line 6-6 of FIG. 4.

FIG. 1 is a perspective view of a tappet 100, which is an example according to some of the present teachings. Tappet 100 includes body 101, crossmember 121 (not visible in FIG. 1), and cam follower 131. FIG. 2 is a perspective view of body 101. FIG. 3 is a perspective view of crossmember 121. Crossmember 121 is mounted within body 101 as shown in FIGS. 4 and 6. FIG. 4 is a perspective of body 101 and crossmember 121 and FIG. 6 is a cross-sectional view corresponding to FIG. 4.

Cam follower 131 include axial support pin 133, bearings 137, and roller 135. Roller 135 is mounted on axial support pin 133 through bearings 137. Cam follower 131 is mounted to body 101 proximate a drive input end 103. Crossmember 121 may rest on a ledge 125 formed on an inner side of body 101. Crossmember 121 may be secured against ledge 125 by dimples 123, which may be formed in body 101 by crimping. Body 101 and crossmember 121 are both formed out of a ferrous metal, which is steel. Crossmember 121 is hardened throughout its thickness, whereas body 101 is only case hardened and has an interior that is malleable. The hardened material, which includes the shell of body 101 and the interior of crossmember 121, has a hardness greater than 500 HV. The malleable material has a hardness less than 500 HV. 500 HV is a Vickers Pyramid Number based on the Vickers hardness test.

Case hardening may harden only the metal within 100 microns of the surface. In some of these teachings, the hardening is limited to within 50 microns of the surface. In some of these teachings, the hardening is limited to within 30 microns of the surface. The thickness of the hardened layer may be between about 10 and 15 microns. The distribution of hardening may be determined by forming sections and taking hardness traces.

Body 101 has a cylinder-conforming bore-running surface 109. Surface 109 is an outer surface of body 101. It is cylinder-conforming in that it follows the shape of a cylinder having axis 151. While surface 109 conforms to the shape of a cylinder, it need not in itself form any complete cylinder. Surface 109 is a bore-running surface in that it is operative to guide translation of tappet 100 when installed in a matching bore and will limit rocking within that bore.

Body 101 is a contiguous piece of ferrous metal that includes anti-rotation guide feature 115. Body 101 has been stamped to form anti-rotation guide feature 115 as an outward protrusion from cylinder-conforming bore-running surface 109. The formation of anti-rotation guide feature 115 by stamping is evident from its continuity with the metal that forms bore-running surface 109. Anti-rotation guide feature 115 has a length 153 extending parallel to axis 151 and meets bore-running surface 109 on a first side 117A and a second side 117B, each of which extends along length 153. Preferably, anti-rotation guide feature 115 meets bore-running surface 109 through most of length 153. More preferably, anti-rotation guide feature 115 meets bore-running surface 109 through its entire length 153. Still more preferably, anti-rotation guide feature 115 meets bore-running surface 109 about its entire perimeter, as is the case for tappet 100 as shown in the figures. These continuity features may be achieved by forming anti-rotation guide feature 115 in a stamping process.

Body 101 includes two parallel planar surfaces 105 proximate drive input end 103. Cam follower 131 includes axial support pin 133, which is mounted to body 101 through axle holes 111 formed in surfaces 105. Surfaces 105 are stamped into body 101. The orientation of cam follower 131 relative to anti-rotation guide feature 115 is related to the orientation of surfaces 105 relative to anti-rotation guide feature 115. Forming both surfaces 105 and anti-rotation guide feature 115 by stamping improves the orientation of cam follower 131 relative to anti-rotation guide feature 115. Moreover, axles holes 111 are also formed by stamping, which further improves their orientation with respect to anti-rotation guide feature 115 and with respect to the bore-running surface 109.

Figure 5:
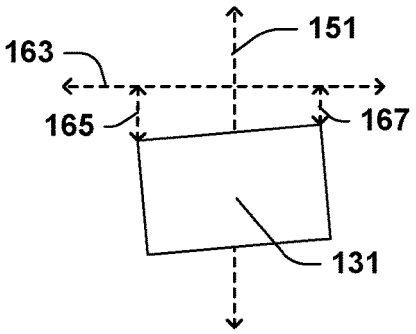
FIG. 5 is a sketch illustrating the measurement of perpendicularity.

A high degree of perpendicularity is achieved between bore-running surface 109 and cam follower 131. FIG. 5 illustrates the measurement of perpendicularity. The perpendicularity is measured as the end-to-end variation of roller 135's distance from a plane 163 that is perpendicular to the axis 151 of bore-running surface 109. That variation is the difference between distance 165 and distance 167. Roller 135 typically has a length in the range from about 5 mm to about 20 mm, with 11 mm being the length in this example. For a roller of this size, it is desirably to maintain a perpendicularity below 45 microns. The present teachings allow a perpendicularity below 30 microns to be achieved. For tappet 100, the perpendicularity is about 20 microns. To relate these perpendicularities to rollers of other sizes, they may be normalized in terms of the 11 mm roller length to give dimensionless perpendicularities of 0.0041, 0.0027, and 0.0018.

The perpendicularity is partially the result of what has not been done to body 101. Bore-running surface 109 has not been subjected to a heat treatment process that would distort its shape. Bore-running surface 109 has not been subjected to OD grinding or any other grinding, milling, or abrading operation that would be suitable for restoring the surface 109 of body 101 to a cylinder-conforming shape following a shape-distorting hardening operation such as carbonitriding. OD grinding leaves behind traces such as grind lines and marks. Bore-running surface 109 does not bear the traces of OD grinding or any other grinding, milling, or abrading operation that would determine its outer diameter 157.

Body 101 also includes planar surfaces 113. Planar surfaces 113 are within transition regions between bore-running surface 109 and parallel planar surfaces 105. Planar surfaces 113 come adjacent parallel planar surfaces 105 proximate ends 107 of parallel planar surfaces 105, which are distal from the drive-input end 103 of body 101. Planar surfaces 113 are inclined relative to axis 151 of the cylinder-conforming bore-running surface 109. The angle of inclination is 40 degrees away from axis 151 which is an angle in the range from 15 to 75 degrees.

Body 101 is case-hardened by a process that diffuses nitrogen into the metal while maintaining the metal in a ferritic phase. The arrangement of the nitrogen atoms within the metal is distinct from the case where nitrogen is added while the metal is in an austenitic phase. The metal is not heated above the critical temperature during case hardening, or afterward. Accordingly, an analysis of the distribution of nitrogen and its structure within the metal lattice will reveal that the parts have been case-hardened by a process that diffuses nitrogen into the metal while maintaining the metal in a ferritic phase. The analysis may be carried out with methods such as X-ray crystallography and scanning electron microscopy.

Figure 7:
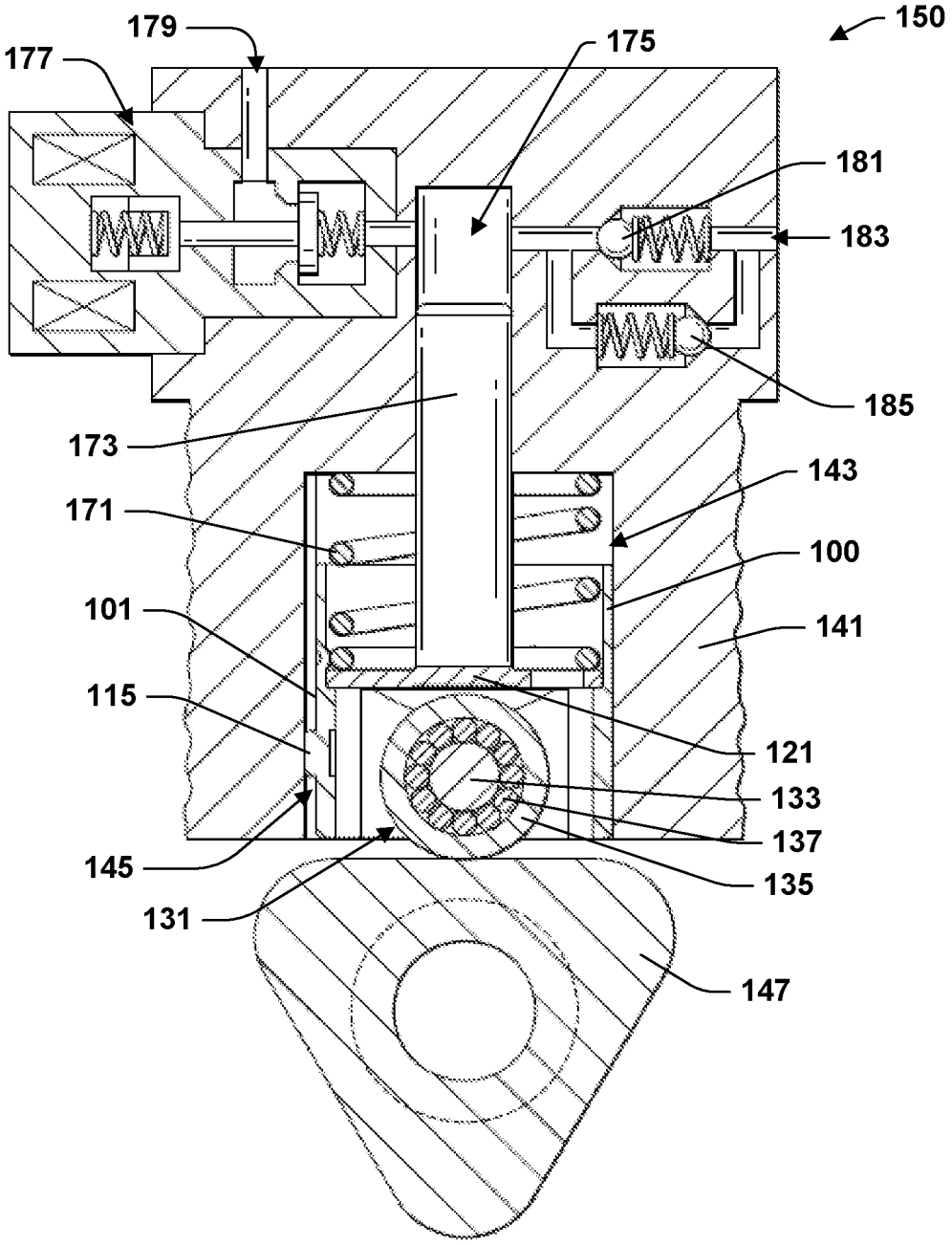
FIG. 7 is an illustration of the tappet of FIG. 1 installed in an engine to operate as a fuel pump actuator in accordance with some aspects of the present teachings.

Tappet 100 is a bucket tappet. Tappet 100 is a high-pressure fuel pump actuator, although the same construction may be used in other tappet applications, as in a roller lifter. FIG. 7 illustrates tappet 100 installed in an engine 150. Engine 150 includes a cylinder head 141 having a bore 143. Tappet 100 is installed within bore 143 and its axis 151 is coaligned with and axis of bore 143. A smaller bore 145 that is parallel to and overlaps bore 143 is also formed in cylinder head 141. A guide groove may be used in place of bore 145. Anti-rotation guide 115 rides within bore 145. A spring 171 within bore 145 biases cam follower 131 against cam 147. Cam 147 has three lobes. Three-lobed and four-lobed cams are typical for high-pressure fuel pumps. Cams with other numbers of lobes can also be used.

An electronically controlled metering valve 177 is configured to selectively admit low pressure fuel from inlet 179 into pumping chamber 175. As cam 147 rotates, it drives tappet 100 upward. Tappet 100 compresses spring 171 and drives piston 173 into pumping chamber 175. Tappet 100 interfaces with piston 173 through crossmember 121. Crossmember 121 transmits force from body 101 to piston 173. Crossmember 121 may be hardened to resist fatigue while performing this function. The fuel within pumping chamber 175 is compressed by piston 173 until it reaches a critical pressure at which check-valve 181 opens to release pressurized fuel to the outlet 183. A high-pressure relief valve 185 may be provided to allow a return flow of fuel to pumping chamber 175 once the pressure at outlet 183 is sufficiently high.

Figure 8:
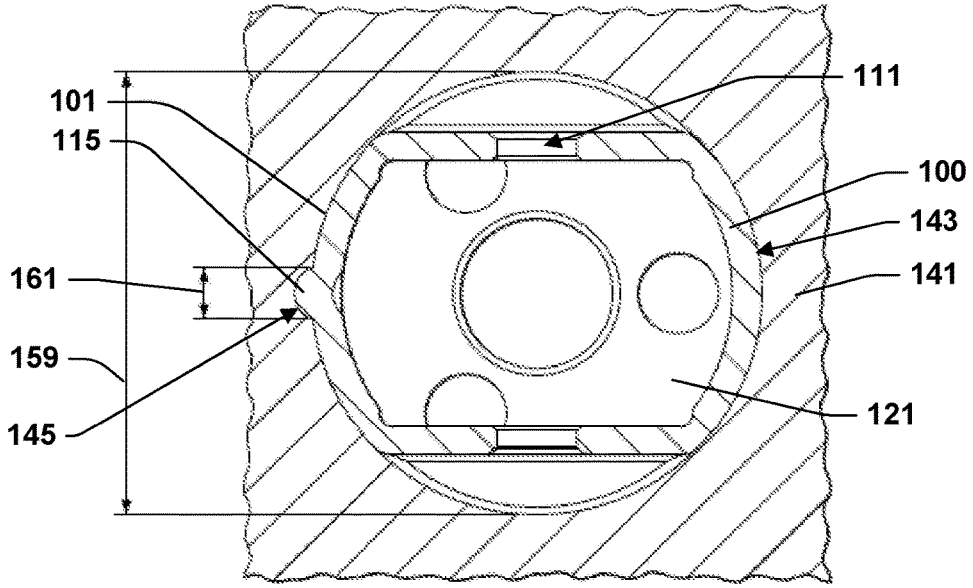
FIG. 8 is a cross-section taken through the line 8-8 of FIG. 4, but showing the tappet as installed in the engine of FIG. 7.

FIG. 8 provides a cross-sectional view of tappet 100 in bore 143. The cross-section corresponds to the tappet cross-section 8-8 identified in FIG. 4. Cam follower 131 is removed from this view to provide greater clarity. As shown in this view, bore-running surface 109 mates with the wall of bore 143. Diameter 157 may be referred to as the nominal outer diameter of tappet 100. Tappet 100 is a high-pressure fuel pump actuator. Diameter 157 may be any of the standard sizes, which include 26 mm, 31 mm, and 32 mm. Accordingly, diameter 157 may be in the range from 26 mm to 32 mm. For the high-pressure fuel pump application, diameter 157 is generally in the range from about 10 mm to about 50 mm. Tappet 100 may alternatively have either a larger or smaller diameter.

The diameter 159 of bore 143 is very slightly larger than diameter 157 of bore-running surface 109 to provide a running clearance. The clearance may be in the range from 10 μm to 40 μm. Anti-rotation guide feature 115 extends out of bore 143 into the space of bore 145. Anti-rotation guide feature 115 mates with the walls of bore 145 to narrowly limit rotation of tappet 100 within bore 143. The diameter 161 of bore 145 may be much smaller than the diameter 159 of bore 143. The diameter 161 is typically in the range from about 2 mm to about 8 mm. The diameter 161 is about 4 mm in this example. The cylinder conforming bore-running surface 109 has a diameter variance less than 50 μm. For example, the variance may be 15 μm.

Figure 9:
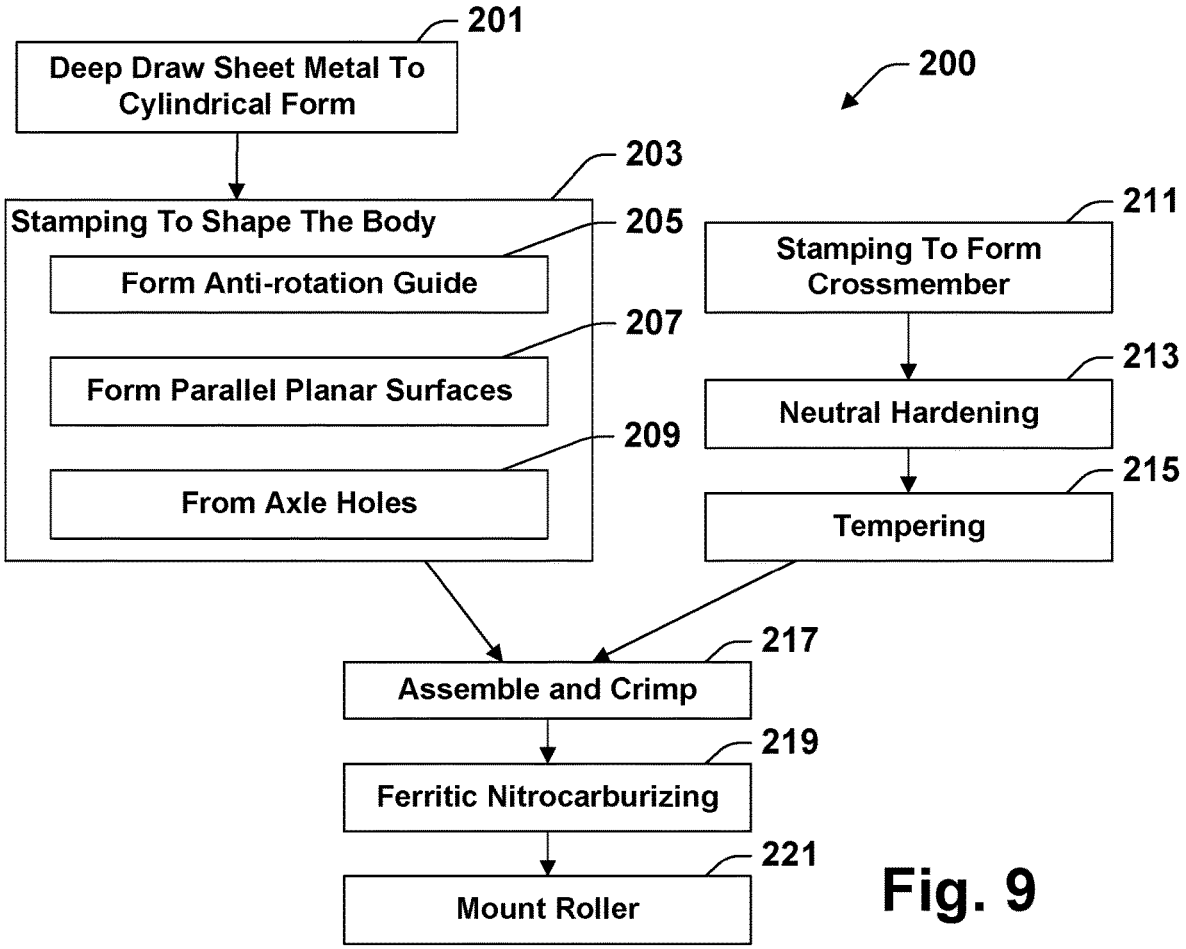
FIG. 9 is a flow chart of a process according to some aspects of the present teachings.

FIG. 9 provides a flow chart of a process 200 that may be used to manufacture the tappet 100. Process 200 begins with a strip of sheet metal, which may be taken from a coil. In act 201, a piece of sheet metal is subjected to deep drawing to produce a cylindrical form. In act 203, the cylindrical form is subjected to a series of stamping operations to produce body 101. These operations may include act 205, which forms anti-rotation guide feature 115, act 207, which forms parallel planar surfaces 105, and act 209, which forms axle holes 111. Act 209 includes piecing and shaving.

Acts 211 through 215 produce and process crossmember 121 independently from body 101. Act 211 is stamping to form crossmember 121. Act 213 is neutral hardening. Neutral hardening includes heating crossmember 121 above the critical temperature and quenching. Act 215 is tempering, a heat treatment process that relieves internal stress developed during the hardening process.

Act 217 is mounting crossmember 121 within body 101 and crimping to hold it against ledge 125. Crimping forms dimples 123. Crossmember 121 may be described as a transverse web and is mounted within body 101. Act 219 is ferritic nitrocarburizing (FNC), which is a case hardening process. FNC is a process that adds nitrogen to a ferrous metal by diffusion while the metal is below a critical temperature. The critical temperature is the temperature at which the metal begins to transition from a ferritic phase to an austenitic phase temperature. The critical temperature is generally around 733° C. The FNC process is preferably carried out between 525° C. and 625° C. The FNC may be a gas FNC process, a salt bath FNC process, or a plasma FNC process.

Act 221 is mounting cam follower 131 to body 101. Roller 135 is mounted on bearings 137 which are mounted on axial support pin 133. Mounting cam follower 131 to body 101 includes fitting axial support pin 133 through axle holes 111. The assembled tappet 100 may be installed in engine 150, in which tappet 100 is operative as a fuel pump actuator.

Although modified by FNC, the metal exposed at bore-running surface 109 of body 101 is essentially metal that is present at the outer surface of the sheet metal following act 201, deep drawing. The stamping operations 203 have little or no effect on the outer diameter 157. The outer diameter 157 is essentially determined by act 201, deep drawing, act 203, stamping, and act 219, FNC. Outer diameter 157 may be essentially determined by act 201, deep drawing, alone.

The components and features of the present disclosure have been shown and/or described in terms of certain embodiments and examples. While a particular component or feature, or a broad or narrow formulation of that component or feature, may have been described in relation to only one embodiment or one example, all components and features in either their broad or narrow formulations may be combined with other components or features to the extent such combinations would be recognized as logical by one of ordinary skill in the art.

The invention claimed is:

1. A tappet, consisting essentially of:

a body that is a contiguous piece of ferrous metal, the body comprising an outer shell and an inner side, the outer shell comprising a bore-running surface and an outward projection that is operative as an anti-rotation guide feature and has been made to project outwardly from the bore-running surface by stamping;

a cam follower mounted to the body with bearings and an axial support pin; and a crossmember held within the body, wherein the outer shell is case-hardened to a first hardness, wherein the inner side comprises a second hardness less than the first hardness, and wherein the crossmember is hardened through its full thickness.

2. The tappet of claim 1, wherein:

the outward projection has a length extending along an axis of the bore-running surface; and the outward projection meets the bore-running surface along two opposite sides of the outward projection both of which extend along the length.

3. The tappet of claim 1 wherein an interface between the outward projection and the bore-running surface forms a perimeter about the outward projection.

4. The tappet of claim 1 wherein the bore-running surface does not bear evidence of any operation that has contributed to determining an outer diameter of the bore-running surface and that has not also been applied to a surface of the outward projection.

5. The tappet of claim 1, wherein:

the body has two parallel planar surfaces at a drive-input end of the body;

an axle hole is formed in each of the two parallel planar surfaces;

the axial support pin is mounted through the axle holes;

the body has two additional surfaces that are planar and are disposed within transition regions between the bore-running surface and the two parallel planar surfaces;

the additional surfaces are adjacent the parallel planar surfaces at ends of the parallel planar surfaces that are distal from the drive-input end of the body; and the additional surfaces are inclined relative to an axis of the bore-running surface at an angle of inclination in a range from 15 to 75 degrees.

6. The tappet of claim 1 wherein the tappet is a pump actuator.

7. The tappet of claim 1, wherein:

the outward projection and the bore-running surface are at a same point along an axis of the bore-running surface; and the bore-running surface is operative to guide translation of the tappet when installed in a matching bore and to limit rocking within the matching bore.

8. A method of manufacturing a tappet, comprising:

forming ferrous sheet metal to provide a body, the body comprising a bore-running surface on an outer shell and the body comprising an inner side;

stamping by which there is formed an outward projection from the bore-running surface;

case hardening, to a first hardness, the outer shell of the body and the outward projection by ferritic nitrocarburization; and mounting, on the inner side of the body, a cam follower at one end of the body, the inner side comprising a second hardness less than the first hardness, wherein the outward projection and the bore-running surface are at a same point along an axis of the bore-running surface, and wherein surfaces of the tappet that are operative to guide translation of the tappet when installed in a matching bore and to limit rocking within the matching bore consist essentially of the bore-running surface.

9. The method of claim 8, wherein a final outer diameter for the bore-running surface is produced without any grinding, milling, or abrading that affects the final outer diameter.

10. The method of claim 8, wherein stamping further comprises forming axle holes through which the cam follower is mounted.

11. The method of claim 8, further comprising:

stamping the body to form two parallel planar surfaces at a drive-input end of the body; and forming axle holes in the two parallel planar surfaces;

wherein the mounting of the cam follower at one end of the body comprises mounting an axial support pin for the cam follower through the axle holes.

12. The method of claim 8, further comprising:

piercing the body in a stamping operation to form axle holes in the body;

wherein the mounting of the cam follower at one end of the body comprises mounting an axial support pin for the cam follower through the axle holes.

13. The method of claim 8, further comprising:

forming a crossmember of ferrous metal;

hardening the crossmember by a process that includes heating the crossmember to temperatures at which the ferrous metal enters an austenitic phase; and mounting the crossmember within the body.

14. The method of claim 8 wherein forming the body out of ferrous metal comprises forming the body out of sheet metal by deep drawing.

15. A tappet, comprising:

a body that is a contiguous piece of ferrous metal, the body comprising an outer shell and an inner side, the outer shell comprising a bore-running surface and an outward projection that is operative as an anti-rotation guide feature and that projects outwardly from the bore-running surface; and a cam follower mounted to the inner side of the body;

wherein the outward projection and the bore-running surface are at a same point along an axis of the bore-running surface; and wherein the outer shell consists essentially of case-hardening of the contiguous piece of ferrous metal to a first hardness, and wherein the inner side comprises a second hardness of the contiguous piece of ferrous metal that is less than the first hardness.

16. The tappet of claim 15, further comprising a crossmember that is hardened through its full thickness held within the body.

17. The tappet of claim 15, wherein:

the outward projection has a length extending along the axis of the bore-running surface; and the outward projection meets the bore-running surface along two opposite sides of the outward projection both of which extend along the length.

18. The tappet of claim 15, wherein an interface between the outward projection and the bore-running surface forms a perimeter about the outward projection.

19. The tappet of claim 15, wherein the bore-running surface does not bear evidence of any operation that has contributed to determining an outer diameter of the bore-running surface and that has not also been applied to a surface of the outward projection.

20. The tappet of claim 15, wherein:

the body further comprises two parallel planar surfaces at its drive-input end;

an axle hole is formed in each of the two parallel planar surfaces;

an axial support pin for the cam follower is mounted through the axle holes;

the body further comprises two additional surfaces that are planar and are disposed within transition regions between the bore-running surface and the two parallel planar surfaces;

the additional surfaces are adjacent the parallel planar surfaces at ends of the parallel planar surfaces that are distal from the drive-input end of the body; and the additional surfaces are inclined relative to the axis of the bore-running surface at an angle of inclination a range from 15 to 75 degrees.

* * * * *